US010399091B2

(12) United States Patent
Kim et al.

(10) Patent No.: US 10,399,091 B2
(45) Date of Patent: Sep. 3, 2019

(54) ELECTROSTATIC PRECIPITATION DEVICE FOR REMOVING PARTICLES IN EXPLOSIVE GASES

(71) Applicant: KOREA INSTITUTE OF MACHINERY & MATERIALS, Daejeon (KR)

(72) Inventors: Yong-Jin Kim, Daejeon (KR); Hak Joon Kim, Daejeon (KR); BangWoo Han, Daejeon (KR); ChangGyu Woo, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 290 days.

(21) Appl. No.: 15/400,030

(22) Filed: Jan. 6, 2017

(65) Prior Publication Data

US 2017/0197220 A1 Jul. 13, 2017

(30) Foreign Application Priority Data

Jan. 8, 2016 (KR) ..... 10-2016-0002709
Nov. 29, 2016 (KR) ..... 10-2016-0160662

(51) Int. Cl.

| | |
|---|---|
| ***B03C 3/78*** | (2006.01) |
| ***B03C 3/45*** | (2006.01) |
| ***B03C 3/12*** | (2006.01) |
| ***B03C 3/38*** | (2006.01) |
| ***B03C 3/08*** | (2006.01) |
| ***B03C 3/41*** | (2006.01) |
| ***B03C 3/60*** | (2006.01) |
| *B03C 3/019* | (2006.01) |

(52) U.S. Cl.

CPC ..... *B03C 3/78* (2013.01); *B03C 3/08* (2013.01); *B03C 3/12* (2013.01); *B03C 3/38* (2013.01); *B03C 3/41* (2013.01); *B03C 3/60* (2013.01); *B03C 3/019* (2013.01); *B03C 2201/10* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,861,355 | A | 8/1989 | Macrow | |
| 4,976,752 | A | 12/1990 | Torok et al. | |
| 7,442,234 | B2 * | 10/2008 | Ilmasti | B03C 3/014 95/65 |
| 8,246,732 | B2 * | 8/2012 | Arai | B01D 47/06 95/224 |

FOREIGN PATENT DOCUMENTS

| | | |
|---|---|---|
| AU | 2010283886 | 6/2011 |
| CA | 2108790 | 4/1995 |

(Continued)

*Primary Examiner* — Amber R Orlando
*Assistant Examiner* — Sonji Turner
(74) *Attorney, Agent, or Firm* — Lex IP Meister, PLLC

(57) ABSTRACT

There is provided an electrostatic precipitation device of explosive exhaust gas particles that can remove by unipolar charging a particulate material such as $SiO_2$ that is included in an explosive exhaust gas by charging the explosive exhaust gas with an indirect charging method of charging through ions that are injected from the outside.

17 Claims, 17 Drawing Sheets

(56) References Cited

FOREIGN PATENT DOCUMENTS

| | | | | |
|---|---|---|---|---|
| CN | 85109674 | | | 8/1986 |
| CN | 85101306 | | | 1/1987 |
| JP | 2006-314999 | | | 11/2006 |
| JP | 3841196 | | | 11/2006 |
| JP | 2008-526499 | | | 7/2008 |
| JP | 2009-142808 | | | 7/2009 |
| JP | 2009142808 | A | * | 7/2009 |
| KR | 10-0750510 | | | 8/2007 |
| KR | 10-0942430 | | | 2/2010 |
| KR | 10-2010-0093807 | | | 8/2010 |
| KR | 10-1039281 | | | 6/2011 |
| KR | 10-1064242 | | | 9/2011 |
| KR | 10-1064488 | | | 9/2011 |
| KR | 10-2012-0008138 | | | 1/2012 |
| KR | 10-1551596 | | | 9/2015 |
| KR | 10-1551597 | | | 9/2015 |
| KR | 10-2016-0148744 | | | 12/2016 |
| KR | 10-1729844 | | | 4/2017 |
| KR | 10-1790842 | | | 11/2017 |

* cited by examiner

Gas amount within charging chamber 100mL/min
External fluid inflow amount of ion injection part 10L/min
Voltage of first high voltage application plate +15kV

ELECTROSTATIC PRECIPITATION DEVICE FOR REMOVING PARTICLES IN EXPLOSIVE GASES

CROSS-REFERENCE TO RELATED APPLICATION

This application claims priority to and the benefit of Korean Patent Application No. 10-2016-0002709 and 2016-0160662 filed in the Korean Intellectual Property Office on Jan. 8, 2016 and Nov. 29, 2016, the entire contents of which are incorporated herein by reference.

BACKGROUND OF THE INVENTION (a) Field of the Invention

The present invention relates to an electrostatic precipitation device for removing particles in explosive exhaust gases.

(b) Description of the Related Art

Exhaust gases that are generated when producing a semiconductor material, device, and product and a memory device are used for a process equipment and in this case, various chemical compounds are together generated. These compounds include inorganic and organic compounds, precipitate of photo-resist, other reaction materials, and various other gases that should be removed from a waste gas before being discharged from a process equipment to the air.

In a semiconductor production process, an exhaust gas containing a harmful material of strong toxicity is generated, and it is prohibited to discharge the exhaust gas in view of pollution prevention. Further, in a semiconductor production process, explosive gases are much generated as an exhaust gas, it is not allowed to discharge an exhaust gas containing a harmful component or dust in the air, and it is required to discharge a safe and clean gas with various processing.

Therefore, conventionally, there has been adapted a method of installing a harmful material processing device that decomposes a harmful material that is included in an exhaust gas with a catalyst, that adsorption removes a harmful material or dust with absorbent, or that converts a harmful material or dust to a harmless material and an exhaust gas processing device having an exhaust path that induces an exhaust gas from a semiconductor production device to a harmful material processing device, inducing an exhaust gas of the semiconductor production device to the harmful material processing device through the exhaust path, and in which the harmful material processing device chemically converts a harmful material to a harmless material or physically removes a harmful material to discharge the harmless material in the air.

As a representative method among conventional methods of processing an explosive gas of exhaust gases, a method such as scrubber, a HEPA filter, or electric dust collection has been used.

However, the scrubber has a wastewater treatment problem and a problem that an extra fine particle removal performance is remarkable low, the HEPA filter has a problem that a process pressure change is caused due to a back pressure change, and the electric dust collection method has a problem that explosion occurs due to discharge in view of an explosive gas characteristic.

Further, there is a problem that a particulate material such as $SiO_2$ may be perfectly removed with a method such as scrubber, a HEPA filter, or electric dust collection.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an electrostatic precipitation device for removing particles in explosive exhaust gases having advantages of being capable of preventing explosion by discharge because direct discharge is not performed to an explosive exhaust gas including a particulate material.

An example embodiment of the present invention provides an electrostatic precipitation device for removing particles in explosive exhaust gases including: a charging chamber where an explosive exhaust gas flows in and out; a charging unit including a first high voltage application plate that is installed within the charging chamber and to which a unipolar high voltage is applied and an ion collection plate that is spaced apart from the first high voltage application plate in a direction intersecting a flow direction of the explosive exhaust gas to be grounded; at least one ion injection part including a communication pipe that communicates with the inside of the charging chamber and a discharge unit that is installed at an external end portion of the communication pipe to generate ions of the same polarity as that of a high voltage that is applied to the discharge unit, and transferring the generated ions to the inside of the charging chamber through the communication pipe; a dust collection chamber where a unipolar charged explosive exhaust gas that is discharged from the charging chamber flows in; and an electrostatic dust collection unit that is installed within the dust collection chamber and including a second high voltage application plate, a collection plate that is spaced apart from the second high voltage application plate to be grounded, and a second water screen forming portion that forms a water screen at a plate surface of the collection plate.

The second high voltage application plate may be installed such that a plate surface thereof is located at one side surface within the dust collection chamber, and the collection plate may be installed such that a plate surface thereof is opposite to the second high voltage application plate at the other side surface within the dust collection chamber to be disposed in a vertical direction of the dust collection chamber.

The collection plate may be hydrophilic surface processed.

The second water screen forming portion may include: a spray unit that is disposed in a horizontal direction of the collection plate to spray a cleaning liquid to the upper end of the collection plate such that a cleaning liquid drops along a surface of the collection plate; and a cleaning liquid supply unit that supplies a cleaning liquid to the spray unit.

The spray unit may be a plurality of sprayers that are arranged in a horizontal direction of the collection plate or a pipe in which a plurality of nozzles are arranged in a horizontal direction of the collection plate.

The first high voltage application plate may be installed such that a plate surface thereof is located as an upper surface and a lower surface at an upper portion within the charging chamber, and the ion collection plate may be installed such that a plate surface thereof is opposite to a plate surface of the first high voltage application plate at a lower portion within the charging chamber, and the communication pipe may be coupled to the charging chamber such that generated ions are injected between the high voltage application plate and the ion collection plate.

The electrostatic precipitation device may include a plurality of ion injection parts including the ion injection part, and the plurality of ion injection parts may be separately arranged in a flow direction of the explosive exhaust gas.

Arrangement gaps of the plurality of ion injection parts may be constantly formed, and the arrangement gap may be larger than a distance between the first high voltage application plate and the ion collection plate.

The ion injection part may further include a fluid inlet that an external fluid is injected through and forms fluid flow to the charging chamber side along the inside of the communication pipe.

The injected external fluid may include ozone that primarily reacts a nitrogen compound among components of the explosive exhaust gas.

The cleaning liquid that is sprayed from the second water screen forming portion may include a reducing solution that reduces the primarily reacted nitrogen oxide of the explosive exhaust gas.

The ion injection part may further include a flow velocity increase portion having a plurality of through-holes and that is installed in a direction intersecting a fluid flow direction of the communication pipe.

The first high voltage application plate may be installed such that a plate surface thereof is located at one side surface within the charging chamber, and the ion collection plate may be installed such that a plate surface thereof is opposite to the first high voltage application plate at the other side surface within the charging chamber to be disposed in a vertical direction of the charging chamber.

The electrostatic precipitation device may further include a first water screen forming portion that forms a water screen at the plate surface of the ion collection plate, wherein the first water screen forming portion may include: an spray unit that sprays a cleaning liquid to the upper end of the ion collection plate such that the cleaning liquid drops along a surface of the ion collection plate and a cleaning liquid supply unit that supplies the cleaning liquid to the spray unit.

The electrostatic precipitation device may further include a bypass pipe that is branched from an outflow pipe of the dust collection chamber to be connected with the fluid inlet of the ion injection part.

Another embodiment of the present invention provides an electrostatic precipitation device for removing particles in explosive exhaust gases having an electric connection structure including: a charging chamber where an explosive exhaust gas flows in and out; a charging portion including a first high voltage application plate that is installed within the charging chamber and an ion collection plate that is separated from the first high voltage application plate; an ion injection part that communicates with the inside of the charging chamber and that injects ions; a dust collection chamber that is connected with the charging chamber and that collects particles of the explosive exhaust gas; a first high voltage generator that is connected with the charging portion; and a second high voltage generator that is connected with the ion injection part and that is grounded together with the first high voltage generator.

The ion collection plate may be in an electrically ground state, and the first high voltage generator may include: a first unipolar terminal that is connected with the first high voltage application plate; and a first ground terminal that is connected with the ion collection plate.

The second high voltage generator may include: a second unipolar terminal that is connected with the ion injection part; and a second ground terminal that is connected with the ion collection plate.

The first high voltage application plate may maintain an electrically ground state, and the first high voltage generator may include: a first unipolar terminal that is connected with the ion collection plate; and a first ground terminal that is connected with the first high voltage application plate.

The second high voltage generator may include: a second unipolar terminal that is connected with the ion injection part; and a second ground terminal that is connected with the first high voltage application plate.

In an electrostatic precipitation device for removing particles in explosive exhaust gases according to an exemplary embodiment of the present invention, because direct discharge is not performed to an explosive exhaust gas including a particulate material, explosion by discharge can be prevented.

DETAILED DESCRIPTION OF THE EMBODIMENTS

Figure 1:
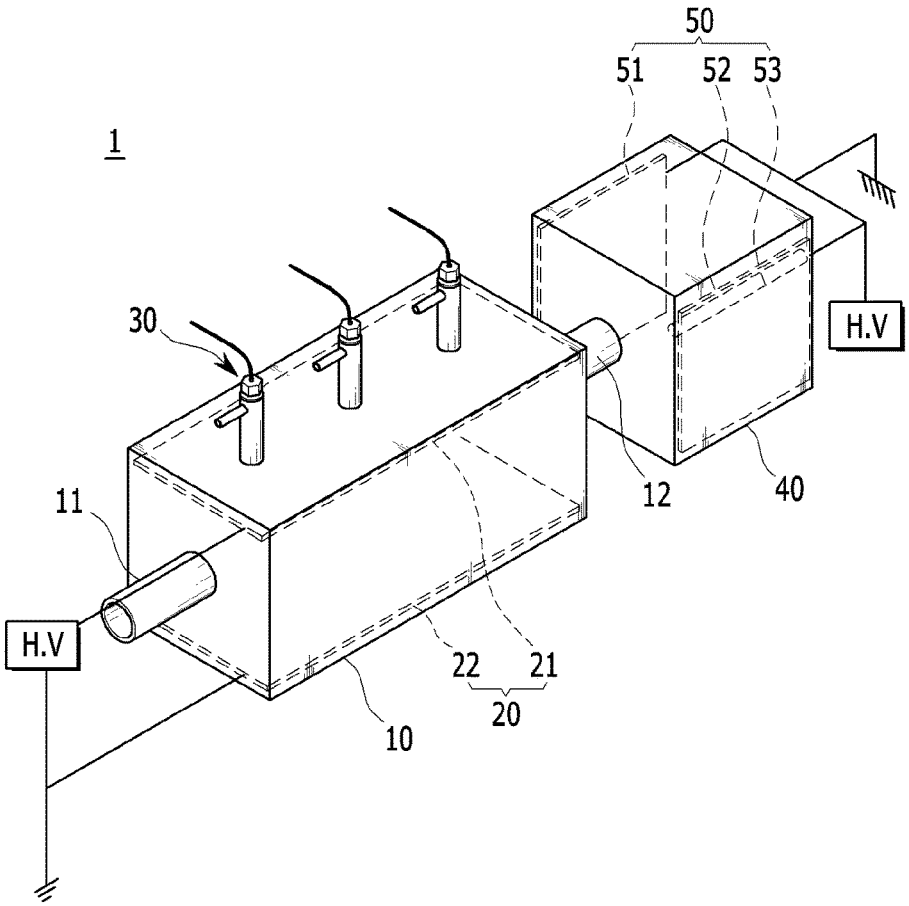
FIG. 1 is a schematic diagram of an electrostatic precipitation device for removing particles in explosive exhaust gases according to a first exemplary embodiment of the present invention.

Hereinafter, the present invention will be described more fully hereinafter with reference to the accompanying drawings, in which example embodiments of the invention are shown. As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Further, in the drawings, a size and thickness of each element are randomly represented for better understanding and ease of description, and the present invention is not limited thereto.

In addition, in the specification, unless explicitly described to the contrary, the word "comprise" and variations such as "comprises" or "comprising", will be understood to imply the inclusion of stated elements but not the exclusion of any other elements.

Figure 2:
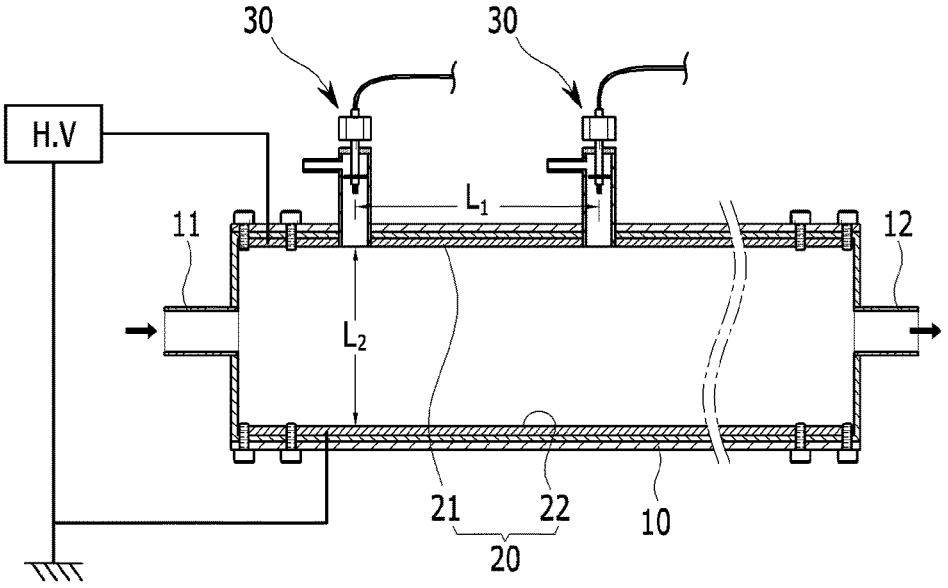
FIG. 2 is a side cross-sectional view of an electrostatic precipitation device for removing particles in explosive exhaust gases of FIG. 1.

FIG. 1 is a schematic diagram of an electrostatic precipitation device for removing particles in explosive exhaust gases according to a first exemplary embodiment of the present invention, and FIG. 2 is a side cross-sectional view of an electrostatic precipitation device for removing particles in explosive exhaust gases of FIG. 1.

Referring to FIG. 1, an electrostatic precipitation device 1 of explosive exhaust gas particles according to a first exemplary embodiment of the present invention includes a charging chamber 10, a charging unit 20, an ion injection part 30, a dust collection chamber 40, and an electrostatic dust collection unit 50.

Referring to FIGS. 1 and 2, the charging chamber 10 is provided in approximately a cuboid shape that is long formed in one direction, and an inflow pipe 11 and an outflow pipe 12 thereof are installed at the left side and the right side, respectively.

An explosive exhaust gas including a particulate material such as $SiO_2$ flows into the charging chamber 10 through the inflow pipe 11 to be moved along the charging chamber 10 and flows out of the charging chamber 10 through the outflow pipe 12.

The charging unit 20 includes a first high voltage application plate 21 and an ion collection plate 22.

The first high voltage application plate 21 is located in a horizontal direction at an upper portion within the charging chamber 10, and a unipolar high voltage having a positive pole (+) or a negative pole (−) is selectively applied thereto.

Further, the ion collection plate 22 is installed to be grounded such that a plate surface thereof is opposite to a plate surface of the first high voltage application plate 21 at the lower portion within the charging chamber 10.

For example, when a positive (+) high voltage is applied to the first high voltage application plate 21, the grounded ion collection plate 22 becomes relatively a negative pole (−), and when a negative (−) high voltage is applied to the first high voltage application plate 21, the grounded ion collection plate 22 becomes relatively a positive pole (+).

In the present exemplary embodiment, the first high voltage application plate 21 is installed at an upper surface of the charging chamber 10, the ion collection plate 22 is installed at a low surface of the charging chamber 10, and a positive (+) high voltage is applied to the first high voltage application plate 21.

Figure 3:
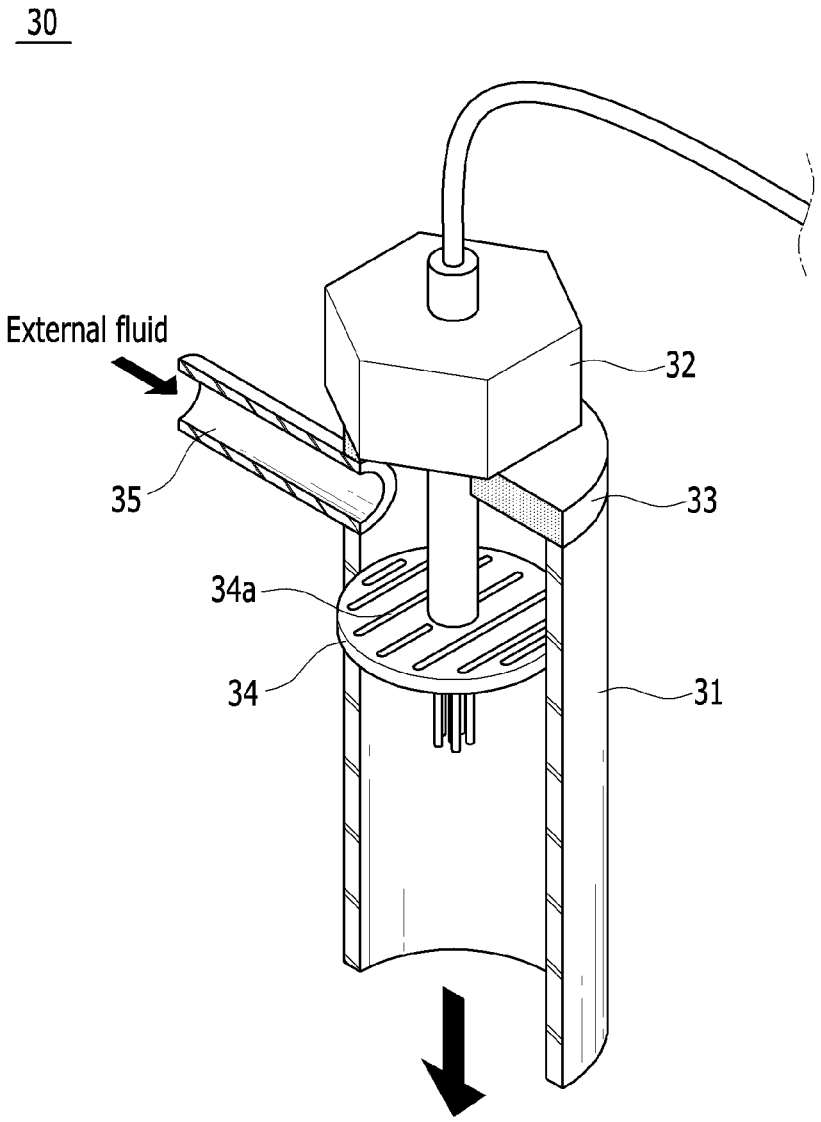
FIG. 3 is a detail view of an ion injection part of FIG. 2.

FIG. 3 is a detail view of an ion injection part of FIG. 2.

Referring to FIG. 3, the ion injection part 30 includes a communication pipe 31, a discharge unit 32, an insulating portion 33, a flow velocity increase portion 34, and a fluid inlet 35.

The communication pipe 31 penetrates an upper side surface of the charging chamber 10 to communicate with the inside of the charging chamber 10.

The discharge unit 32 is installed at an external end portion of the communication pipe 31, and a high voltage is applied and discharged to a superfine fiber electrode using superfine fibers such as a metal fiber or a carbon fiber.

Upon discharging, at an end portion of the electrode, ions having the same polarity as that of a high voltage that is applied to the first high voltage application plate 21 are generated and injected into the communication pipe 31 along fluid flow that is formed by the fluid inlet 35.

The insulating portion 33 is installed between the discharge unit 32 and the communication pipe 31 to insulate the discharge unit 32 and the communication pipe 31, thereby preventing discharge from occurring in the communication pipe 31.

The flow velocity increase portion 34 is a plate member having a through-hole 34*a* such as a slit, a circle, and an oval and is installed in a direction intersecting a fluid flow direction within the communication pipe 31 to block fluid flow. As shown in FIG. 3, the through-hole 34*a* is formed in a slit shape.

That is, a flow channel cross-section within the communication pipe 31 reduces by the flow velocity increase portion 34, and as a fluid passes through the through-hole 34*a*, a fluid flow velocity increases.

The fluid inlet 35 injects an external fluid to form fluid flow to the charging chamber 10 side along the inside of the communication pipe 31.

Ions that are generated by the discharge unit 32 along fluid flow that is formed by the fluid inlet 35 to move into the charging chamber 10.

For example, an external fluid that is injected through the fluid inlet 35 may be oxygen ($O_2$), carbon dioxide ($CO_2$), ozone ($O_3$), or a mixed gas thereof. When forming the discharge unit 32 with a corona discharge method, it is preferable that an external fluid is formed with air.

Ozone ($O_3$) may primarily react with a NOx component among explosive exhaust gases. For example, in explosive exhaust gases, NO may react as in $NO+O_3 \rightarrow NO_2+O_2$. $NO_2$ may be reduced by a reducing solution that is included in a cleaning liquid. This will be described later.

In order to improve electrostatic dust collection efficiency, a plurality of ion injection parts 30 may be separately arranged in a length direction of the charging chamber 10.

In this case, when a gap between the discharge units 32 of the ion injection part 30 prevents ions that are injected into the charging chamber 10 from being overlapped, an entire explosive exhaust gas may be charged with minimum ion generation.

Further, because ions generated by the discharge unit 32 are injected into charging chamber 10 to induce a charge to the ion collection plate 22, and a distance between the first high voltage application plate 21 and the ion collection plate 22 is appropriately formed; thereby, resulting in an improvement to a charging rate of an explosive exhaust gas.

Therefore, in order to maximize a charging rate, a gap between the discharge units 32 and a distance between the first high voltage application plate 21 and the ion collection plate 22 may be appropriately disposed.

Figure 4:
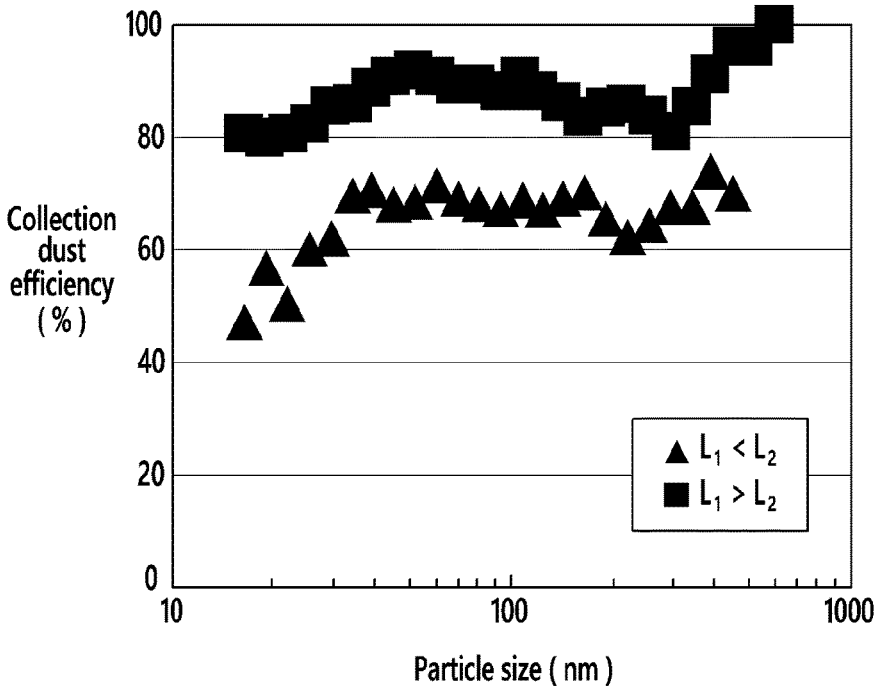
FIG. 4 is a graph illustrating electrostatic dust collection efficiency according to a separation gap of an internal discharge portion of the ion injection part of FIG. 3.

FIG. 4 is a graph illustrating electrostatic dust collection efficiency according to a separation gap of an internal discharge portion of the ion injection part of FIG. 3.

Referring to FIG. 4, when a gap L1 between the discharge units 32 is formed larger than a distance L2 between the first high voltage application plate 21 and the ion collection plate 22, it may be determined that dust collection efficiency is higher in an entire particle size, compared with when the gap L1 between the discharge units 32 is formed smaller than a distance L2 between the first high voltage application plate 21 and the ion collection plate 22.

Therefore, by forming a gap L1 between the discharge units 32 to be larger than a distance L2 between the first high voltage application plate 21 and the ion collection plate 22, a charging rate is improved to maximize dust collection efficiency.

The dust collection chamber 40 is provided in an approximately cuboid or cube shape to be coupled to the outflow pipe 12 of the charging chamber 10 and thus a unipolar charged explosive exhaust gas from the charging chamber 10 flows into the dust collection chamber 40 through the outflow pipe 12.

The electrostatic dust collection unit 50 includes a second high voltage application plate 51, a collection plate 52, and a second water screen forming portion 53.

The second high voltage application plate 51 is installed such that a plate surface thereof is located in a vertical direction at an internal side surface of the dust collection chamber 40 and thus a high voltage is applied thereto.

Figure 5:
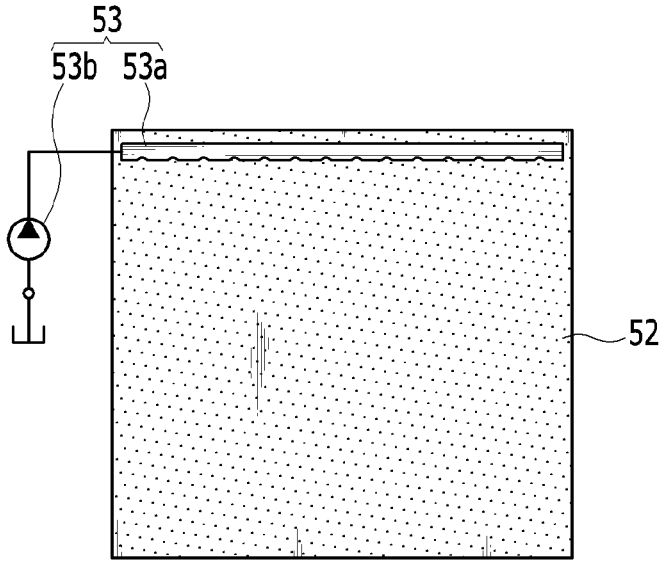
FIG. 5 is a cross-sectional view of an electrostatic dust collection unit of an electrostatic precipitation device for removing particles in explosive exhaust gases of FIG. 1.
Figure 6:
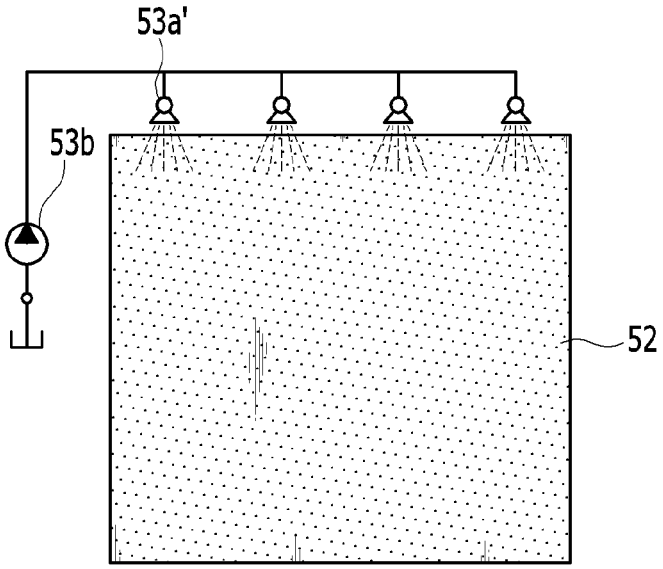
FIG. 6 is a diagram illustrating a sprayer as a spray unit of a second water screen forming portion of FIG. 5.

FIG. 5 is a cross-sectional view of an electrostatic dust collection unit of an electrostatic precipitation device for removing particles in explosive exhaust gases of FIG. 1, and FIG. 6 is a diagram illustrating a sprayer as an spray unit of a second water screen forming portion of FIG. 5.

Referring to FIGS. 1, 5 and 6, the collection plate 52 is spaced apart from the second high voltage application plate 51 and is installed to be grounded such that a plate surface thereof is located in a vertical direction.

The collection plate 52 may be hydrophilic surface processed and provided using a surface processing construction method of forming a hydrophilic surface such as ball blasting.

Specifically, when strongly ejecting a ball-shaped metal particles to the collection plate 52 with compression air or other different methods, a plurality of depressed parts that are minutely depressed are formed at a surface of the collection plate 52. A plate surface of the collection plate 52 may be a hydrophilic surface by such a processing.

The second water screen forming portion 53 includes a spray unit 53*a* and a cleaning liquid supply unit 53*b*.

The spray unit 53*a* is disposed in a horizontal direction at the upper end of the collection plate 52 or at a location adjacent to the upper end thereof. Here, the spray unit 53*a* is provided in a pipe having a plurality of nozzles in a length direction.

The cleaning liquid supply unit 53*b* is connected with the spray unit 53*a* to supply a cleaning liquid.

When a cleaning liquid is ejected to a surface of the collection plate 52 through the second water screen forming portion 53, the cleaning liquid may wash and reduce particles that are collected at a surface of the collection plate 52 while dropping downward along a surface of the collection plate 52.

For example, a cleaning liquid may include a reducing solution. A NOx component of the explosive exhaust gas may be primarily reacted by ozone and may be reduced by a cleaning liquid. A reducing solution, for example, $Na_2S$ is primarily reacted and thus nitrogen dioxide ($NO_2$) that is included in the explosive exhaust gas component may be reacted into $2NO_2+Na_2S \rightarrow Na_2SO_4+N_2$. Therefore, NOx, which is a pollution material in the explosive exhaust gas component may be removed.

That is, by forming a water screen through the second water screen forming portion 53, a life-span of a washing cycle or a replacement cycle of the collection plate 52 may be extended.

The spray unit 53*a* is provided in a form of an individually provided plurality of sprayers 53*a*' to be separately arranged in a horizontal direction to the collection plate 52.

Hereinafter, operation of an electrostatic precipitation device for removing particles in explosive exhaust gases according to the first exemplary embodiment of the present invention will be described.

Figure 7:
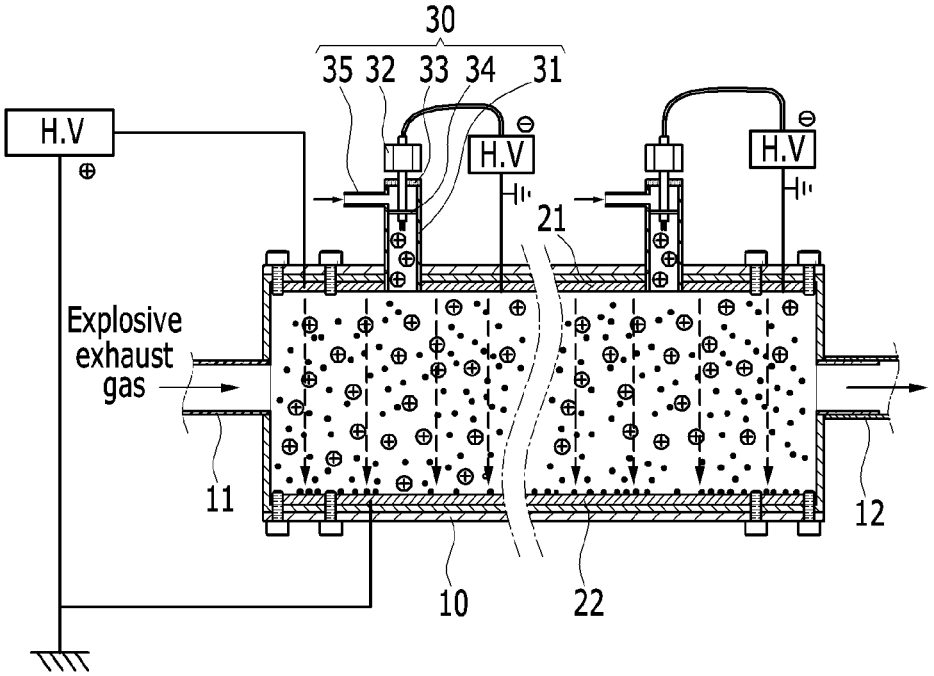
FIGS. 7 to 9 are operation state diagrams illustrating an operation state of an electrostatic precipitation device for removing particles in explosive exhaust gases according to an exemplary embodiment of the present invention.
Figure 8:
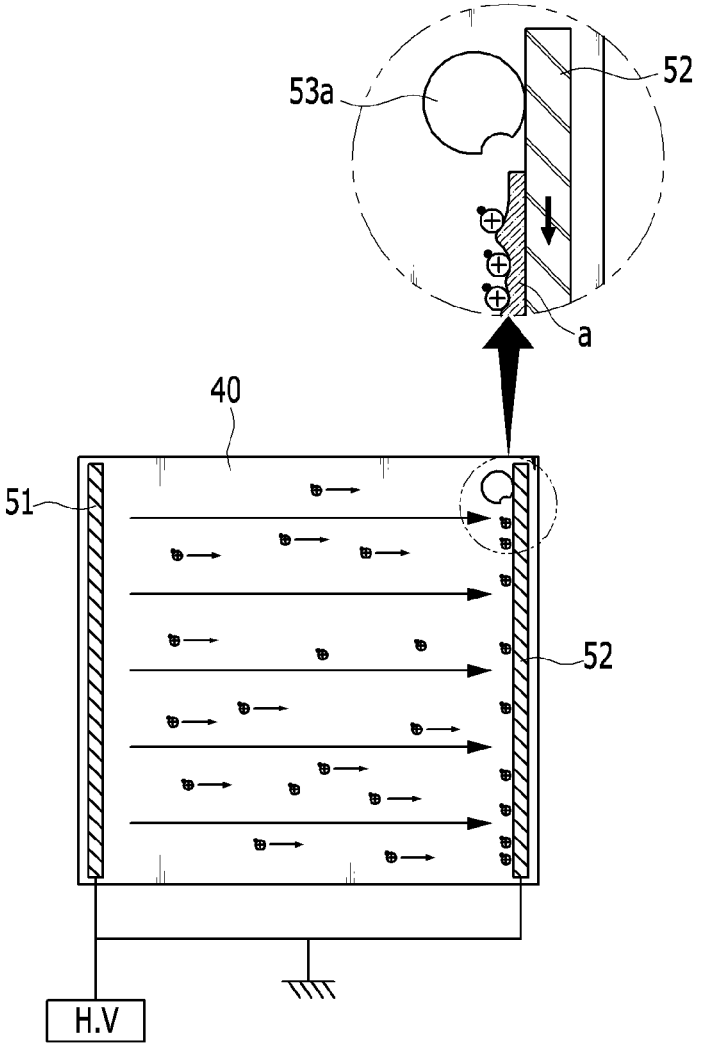
Figure 9:
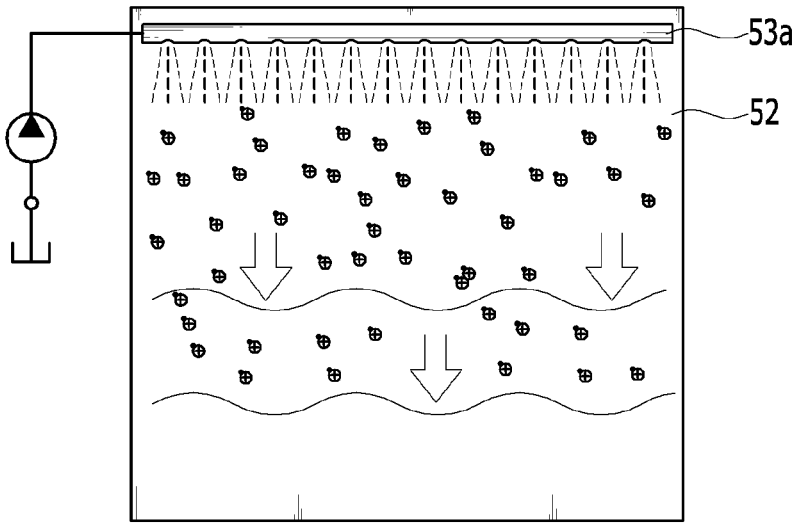

FIGS. 7 to 9 are operation state diagrams illustrating an operation state of an electrostatic precipitation device for removing particles in explosive exhaust gases according to an exemplary embodiment of the present invention.

Referring to FIG. 7, an explosive exhaust gas flows into the charging chamber 10 through an inflow pipe 11 of the charging chamber 10. In this case, when a positive (+) high voltage is applied to the first high voltage application plate 21, the electrically ground ion collection plate 22 becomes relatively a negative pole (−) and thus an electric field is formed between the first high voltage application plate 21 and the ion collection plate 22.

By applying the same positive pole (+) as the polarity of a unipolar high voltage that is applied to the first high voltage application plate 21 to the discharge unit 32, the ion injection part 30 generates positive ions within the communication pipe 31, and the generated positive ions move along fluid flow that is formed at the charging chamber 10 side along the communication pipe 31 through the fluid inlet 35 to move into the charging chamber 10.

In this case, in fluid flow within the communication pipe 31, as a flow velocity increases by the flow velocity increase portion 34, positive ions may be supplied in a speed corresponding to a flow velocity of the explosive exhaust gas moving within the charging chamber 10.

Positive ions that are injected into the charging chamber 10 are pushed to the ion collection plate 22 side by a repulsive force with the first high voltage application plate 21 of a positive pole (+) and are pulled by attraction with the ion collection plate 22 of a negative pole (−).

In this case, a portion of positive ions unipolar charges explosive exhaust gas particles to a positive pole (+), and the remaining portions thereof are collected at the ion collection plate 22. Thereby, particles of an explosive exhaust gas that is unipolar charged to a positive pole (+) are discharged to the dust collection chamber 40 side through the outflow pipe 12 of the charging chamber 10.

Here, particles of an explosive exhaust gas that is unipolar charged in a positive pole (+) may be a particulate material such as $SiO_2$.

Referring to FIGS. 8 and 9, at the inside of the dust collection chamber 40, when a high voltage is applied to the second high voltage application plate 51, an electric field is formed between the second high voltage application plate 51 and the collection plate 52, and at a surface of the collection plate 52, a water screen is formed by the second water screen forming portion 53.

In this case, the polarity of a high voltage that is applied to the second high voltage application plate 51 becomes a positive pole (+) and thus the collection plate 52 becomes a negative pole (−).

Further, at a surface of the collection plate 52, a water screen is formed by the second water screen forming portion 53. In this case, the water screen may be generated when a cleaning liquid that is ejected by the spray unit 53*a* is ejected to a surface of the collection plate 52 and quickly drops downward along a surface of the collection plate 52. A drop speed at a surface of the collection plate 52 is further improved by a hydrophilic surface processing of the collection plate 52.

In such a state, an explosive exhaust gas that is unipolar charged in a positive pole (+) that is flowing into the dust collection chamber 40, particularly a particulate material that is unipolar charged in a positive pole (+) moves to the collection plate 52 side along an electric field to be collected at a surface of the collection plate 52.

In this case, explosive exhaust gas particles that are unipolar charged in a positive pole (+) that is collected in the collection plate 52 drop downward along a water screen to be washed away or drop downward together with a water screen before being collected in the collection plate 52 to be washed away.

Accordingly, direct discharge is not performed to an explosive exhaust gas including a particulate material, thereby preventing an explosion risk by discharge.

Further, a particulate material such as $SiO_2$ that is included in an explosive exhaust gas may be perfectly collected and removed through unipolar charge.

Figure 10:
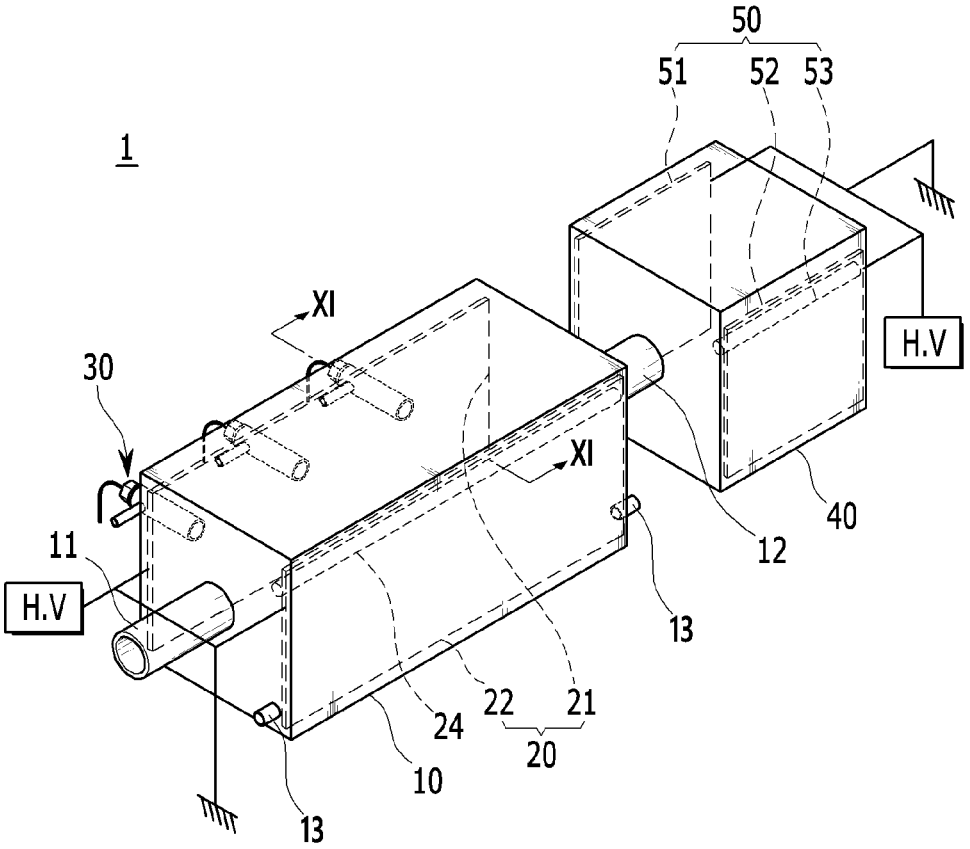
FIG. 10 is a schematic diagram illustrating an electrostatic precipitation device for removing particles in explosive exhaust gases according to a second exemplary embodiment of the present invention.
Figure 11:
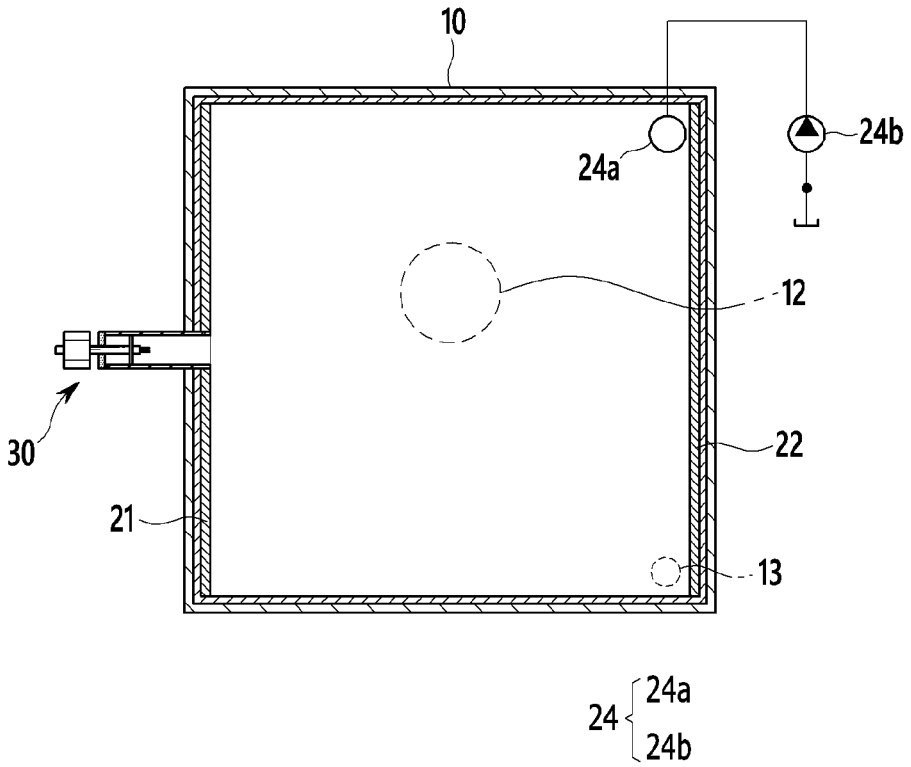
FIG. 11 is a cross-sectional view illustrating the electrostatic precipitation device taken along line XI-XI of FIG. 10.

FIG. 10 is a schematic diagram illustrating an electrostatic precipitation device for removing particles in explosive exhaust gases according to a second exemplary embodiment of the present invention, and FIG. 11 is a cross-sectional view illustrating the electrostatic precipitation device taken along line XI-XI of FIG. 10.

In FIGS. 10 and 11, a description identical to or corresponding to that of the foregoing description is omitted, and only the difference from the foregoing description will be described in detail.

Referring to FIGS. 10 and 11, the charging chamber 10 may include a first water screen forming portion 24.

The first water screen forming portion 24 may include an spray unit 24*a* and a cleaning liquid supply unit 24*b*. For example, the spray unit 24*a* may be disposed at the upper end of the ion collection plate 22.

That is, in order to form a water screen in a flow direction of the explosive exhaust gas, the first water screen forming portion 24 may be disposed in a horizontal direction. Here, the spray unit 24*a* is provided in a pipe having a plurality of nozzles in a length direction. The cleaning liquid supply unit 24*b* may be connected with the spray unit 24*a* to supply a cleaning liquid.

When a cleaning liquid is ejected to a surface of the ion collection plate 22 through the first water screen forming portion 24, the cleaning liquid may wash particles and refuse that are collected at a surface of the ion collection plate 22 along a surface of the ion collection plate 22. The cleaning liquid may be drained out of the charging chamber 10 through an outlet 13 that is formed at the low end of the charging chamber 10.

That is, by forming a water screen at the ion collection plate 22 through the first water screen forming portion 24, a life-span of a washing cycle or a replacement cycle of the ion collection plate 22 may be extended and dust that is included in the explosive exhaust gas may be removed.

In another example, the spray unit 24*a* may be provided in a form of an individually provided plurality of sprayers to be separately arranged in a horizontal direction of the ion collection plate 22.

Figure 12:
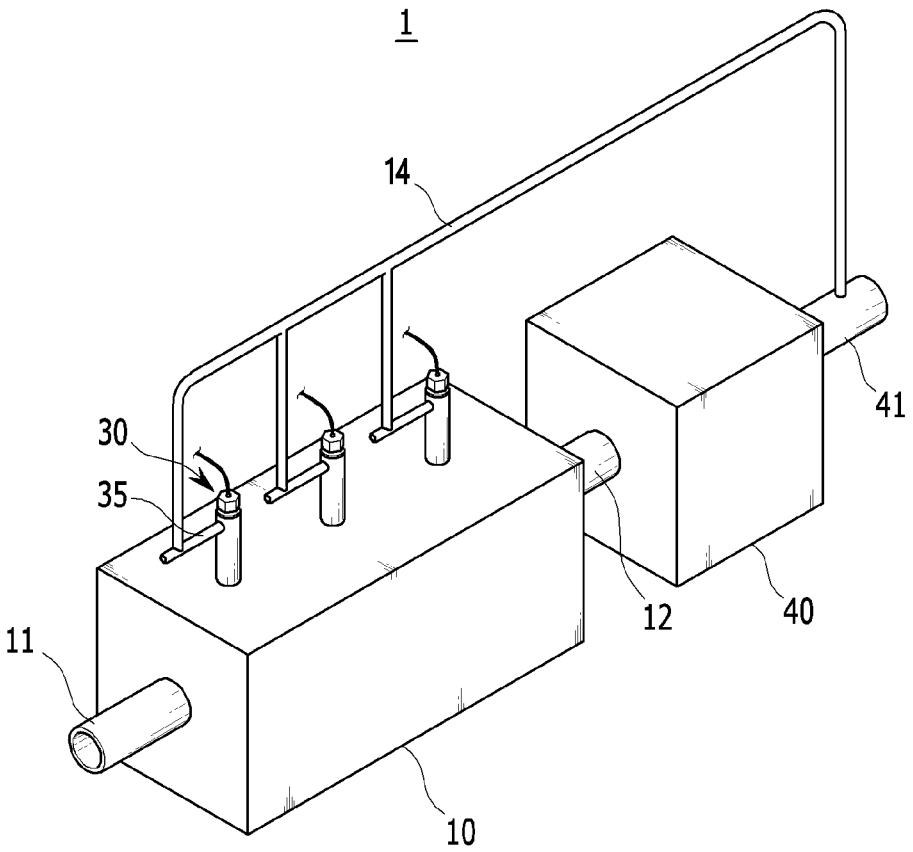
FIG. 12 is a diagram illustrating a bypass pipe that is connected with an ion injection part of FIG. 10.

FIG. 12 is a diagram illustrating a bypass pipe that is connected with an ion injection part of FIG. 10.

Referring to FIG. 12, the electrostatic precipitation device may further include a bypass pipe 14 that connects an outflow pipe 41 and the fluid inlet 35. Accordingly, a portion of an explosive exhaust gas, having penetrated the dust collection chamber 40 may be transferred to the fluid inlet 35 of the ion injection part 30.

An external fluid of an inert gas may be injected into the fluid inlet 35 and mixed with a portion of an explosive exhaust gas in which dust is removed by penetrating the dust collection chamber 40 to be injected into the charging chamber 10, thereby saving the injected external fluid and improving operation efficiency.

Figure 13:
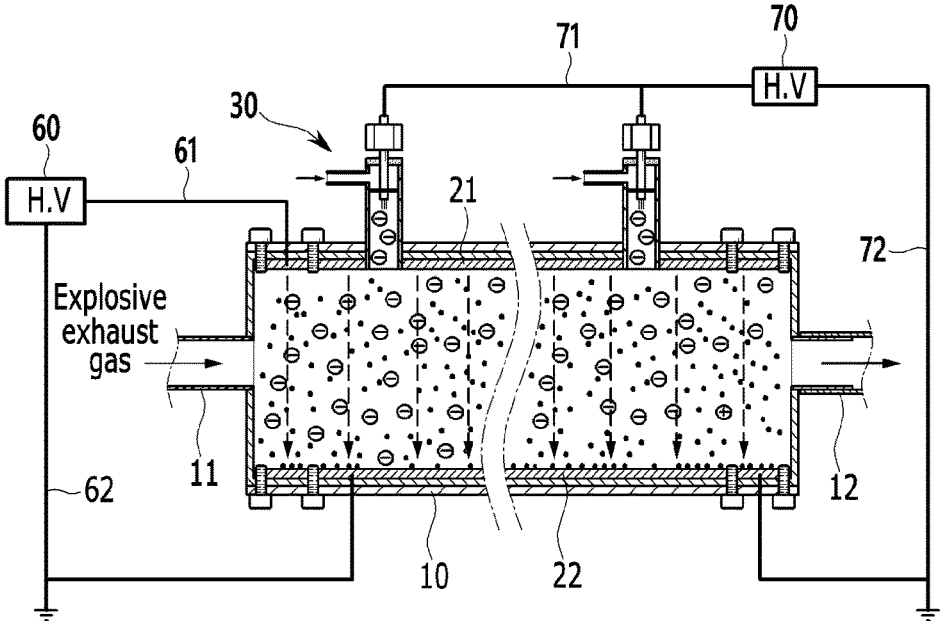
FIG. 13 is a diagram illustrating an electric connection structure and an operation state according to an example of a charging portion of FIG. 1.

FIG. 13 is a diagram illustrating an electric connection structure and an operation state according to an example of a charging portion of FIG. 1.

Referring to FIG. 13, the ion collection plate 22 may be in an electrically ground state.

One terminals of a first high voltage generator 60 and a second high voltage generator 70 are connected with the ion collection plate 22 in an electrically ground state, and the remaining terminals thereof may be connected with the charging unit 20 and the ion injection part 30, respectively.

That is, a first unipolar terminal 61 of the first high voltage generator 60 may be connected with the first high voltage application plate 21 of the charging unit 20, and a first ground terminal 62 of the first high voltage generator 60 may be connected with the ion collection plate 22. A second unipolar terminal of the second high voltage generator 70 may be connected with the ion injection part 30, and a second ground terminal 72 may be electrically connected to the ion collection plate 22.

By applying a unipolar high voltage to the first high voltage application plate 21 through the first unipolar terminal 61, the first high voltage generator 60 may form an electric field between the first high voltage application plate 21 and the ion collection plate 22. A negative (−) high voltage may be applied to the first unipolar terminal 61. Hereinafter, it is exemplified that a negative (−) high voltage is applied to the first unipolar terminal 61.

A negative (−) high voltage is applied to the first high voltage application plate 21 through the first unipolar terminal 61, and thus the electrically grounded ion collection plate 22 has a higher voltage than that of the first high voltage application plate 21 to be a relatively positive pole (+).

For example, when a high voltage of −5 kV is applied to the first high voltage application plate 21, even if a voltage of the electrically grounded ion collection plate 22 is 0 kV, the electrically grounded ion collection plate 22 has a higher voltage than that of the first high voltage application plate 21 to be a relatively positive pole (+). Finally, because the electrically grounded ion collection plate 22 has a higher potential than that of the first high voltage application plate 21, the electrically grounded ion collection plate 22 becomes a relatively positive pole (+).

An electric field is formed between the first high voltage application plate 21 and the ion collection plate 22. For example, by adjusting a magnitude of a negative (−) high voltage that is applied from the first unipolar terminal 61 to the first high voltage application plate 21, a magnitude and intensity of an electric field that is formed between the first high voltage application plate 21 and the ion collection plate 22 may be adjusted.

A second unipolar terminal of the second high voltage generator 70 may apply a negative (−) high voltage and may be connected with the ion injection part 30. In this case, the second ground terminal 72 may be electrically connected to the ion collection plate 22.

For example, a negative (−) high voltage of the same polarity as that of a high voltage that is applied to the first high voltage application plate 21 may be applied to the ion injection part 30. The ion injection part 30 may generate negative (−) ions. The ion injection part 30 may supply negative (−) ions in a speed corresponding to a flow velocity of a moving explosive exhaust gas.

The ion injection part 30 injects negative (−) ions into the charging chamber 10, is pushed to the ion collection plate 22 side by a repulsive force with the first high voltage application plate 21 of a negative pole (−), and is pulled by attraction with the ion collection plate 22, which is a relatively positive pole (+).

A portion of negative (−) ions that are discharged from the ion injection part 30 charges explosive exhaust gas particles to the negative pole (−), and the remaining portions thereof are collected in the ion collection plate 22. Thereby, particles of an explosive exhaust gas that is charged to a negative pole (−) may be discharged to the dust collection chamber 40 side through the outflow pipe 12 of the charging chamber 10.

As a magnitude of a negative (−) high voltage that is applied to the first high voltage application plate 21 through the first high voltage generator 60 increases, negative (−) ions that are discharged from the ion injection part 30 may increase a repulsive force with the first high voltage application plate 21, and a magnitude of an electric field that is formed between the first high voltage application plate 21 and the ion collection plate 22 may increase.

Negative (−) ions that are discharged from the ion injection part 30 more quickly move in a large amount to the ion collection plate 22 and more explosive exhaust gas particles may be unipolar charged by such negative (−) ions.

Figure 14:
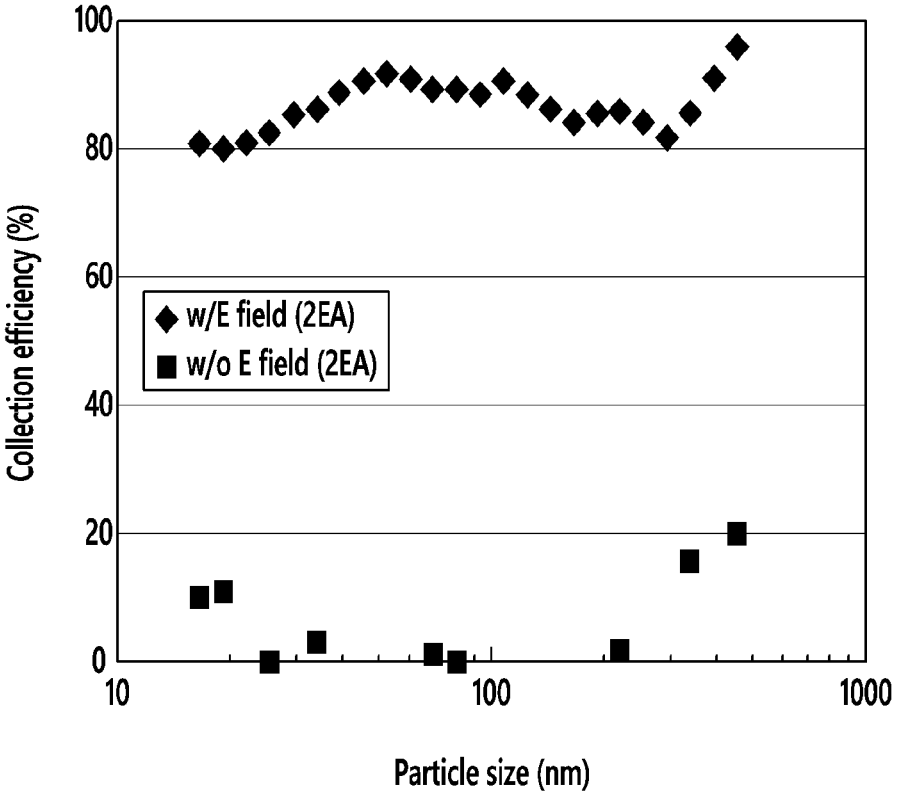
FIG. 14 is a diagram illustrating dust collection efficiency according to whether or not existence of a high voltage that is applied to a charging portion of FIG. 13.
Figure 15:
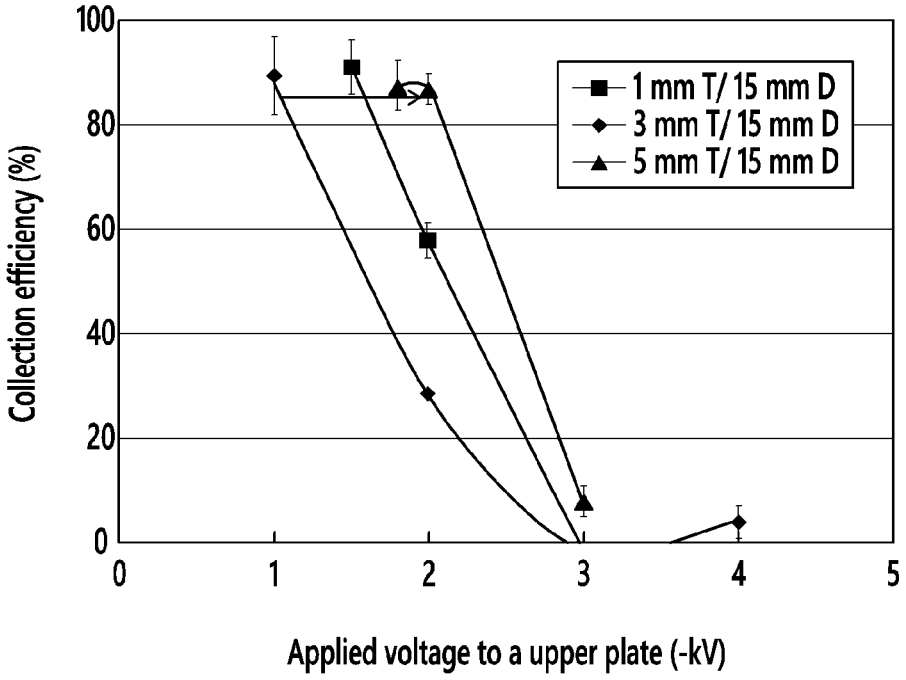
FIG. 15 is a diagram illustrating dust collection efficiency according to a high voltage application amount of FIG. 14.

FIG. 14 is a diagram illustrating dust collection efficiency according to whether or not existence of a high voltage that is applied to the charging portion of FIG. 13, and FIG. 15 is a diagram illustrating dust collection efficiency according to a high voltage application amount of FIG. 14.

Referring to FIGS. 14 to 15, a large change occurs in dust collection efficiency according to whether there is a negative (−) high voltage that is applied from the first high voltage generator 60 to the first high voltage application plate 21.

For example, when an electric field is formed in a direction of the ion collection plate 22 in the first high voltage application plate 21, an electrostatic force is generated, thereby largely improving dust collection efficiency. That is, because a unipolar high voltage is not applied to the first high voltage application plate 21, when an electric field is not formed in a direction of the ion collection plate 22 in the first high voltage application plate 21, dust collection efficiency is almost 0, but when an electric field is formed in a direction of the ion collection plate 22 in the first high voltage application plate 21, dust collection efficiency of 80% or more is formed.

Hereinafter, when a thickness of the first high voltage application plate 21 is 1 mm, it is exemplified that a negative (−) high voltage is applied to the first high voltage application plate 21.

As an experiment result, when −1.3 Kv is applied to the first high voltage application plate, dust collection efficiency becomes about 90%. As a result of an experiment that changes a thickness of the first high voltage application plate 21 and that applies a unipolar high voltage, a magnitude of an applied negative (−) high voltage increases in proportional to a thickness of the first high voltage application plate 21. However, when increasing a unipolar high voltage, dust collection efficiency rapidly decreases and thus there is a limitation in voltage increase.

Figure 16:
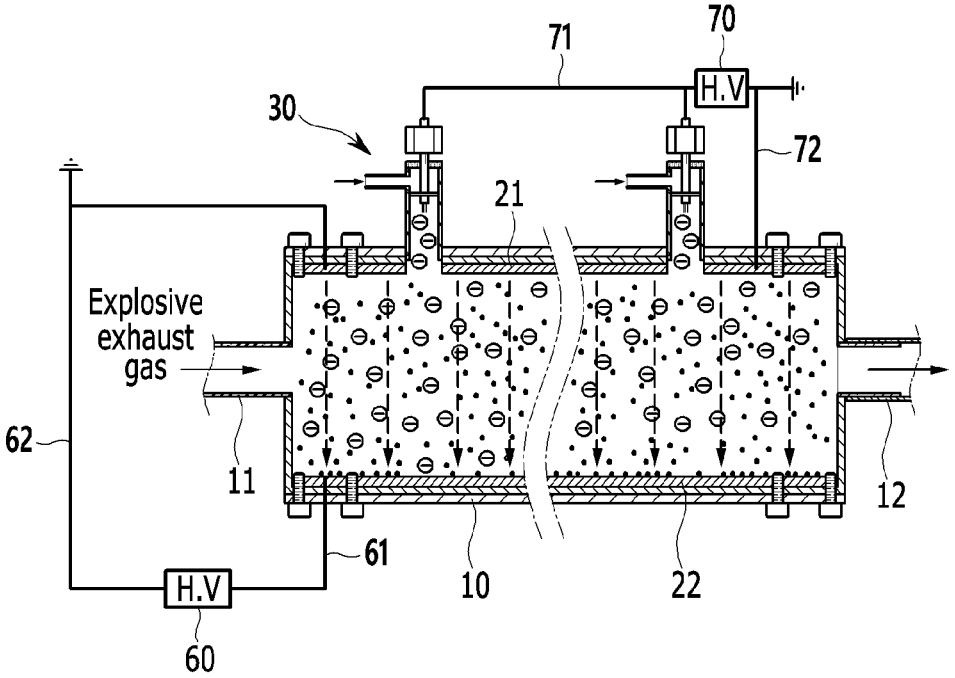
FIG. 16 is a diagram illustrating an electric connection structure and an operation state according to another example of a charging portion of FIG. 13.

FIG. 16 is a diagram illustrating an electric connection structure and an operation state according to another example of the charging portion of FIG. 13.

Hereinafter, in FIG. 16, a description identical to or corresponding to that of FIG. 13 is omitted, and only the difference in an electric connection structure and an operation state of a charging portion will be described in detail.

Referring to FIG. 16, the first unipolar terminal 61 of the first high voltage generator 60 may be connected with the ion collection plate 22, and the first ground terminal 62 may be connected with the first high voltage application plate 21. That is, by connecting opposite to the electric connection structure of FIG. 13, the first high voltage application plate 21 may be electrically grounded.

In this case, the first high voltage generator 60 may apply the ion collection plate 22 to a positive pole (+) through the first unipolar terminal 61. Therefore, the electrically grounded first high voltage application plate 21 may be relatively a negative pole (−).

Specifically, negative electrons (−) of the ion collection plate 22 may move to the first high voltage generator 60 through the first unipolar terminal 61 and thus the ion collection plate 22 may be a positive pole (+).

The first ground terminal 62 of the first high voltage generator 60 may be connected with the first high voltage application plate 21 to be grounded, and an electric field may be formed between the ion collection plate 22 and the first high voltage application plate 21.

For example, when a high voltage of +1 kV is applied to the ion collection plate 22, even if the electrically grounded first high voltage application plate 21 is 0 kV, the electrically grounded first high voltage application plate 21 has a lower potential than that of the ion collection plate 22 to be relatively a negative pole (−). Finally, the electrically grounded first high voltage application plate 21 has a lower potential than that of the ion collection plate 22 to be relatively a negative pole (−).

The ion injection part 30 is connected with a second unipolar terminal 71 of the second high voltage generator 70, and a negative (−) high voltage may be applied thereto. Therefore, the ion injection part 30 may inject negative (−) electrons into the charging chamber 10. In this case, the ion injection part 30 to which a negative (−) high voltage is applied is disconnected with the first high voltage application plate 21. That is, a negative (−) electrode that is applied to the ion injection part 30 prevents a high voltage from being injected into the charging chamber 10 through the grounded first high voltage application plate 21.

The second ground terminal 72 of the second high voltage generator 70 may be connected with the first high voltage application plate 21. The ion injection part 30 may generate negative (−) ions and supply negative (−) ions in a speed corresponding to a flow velocity of a moving explosive exhaust gas.

An electric field is formed between the first high voltage application plate 21 and the ion collection plate 22. For example, by adjusting a magnitude of a positive (+) high voltage that is applied to the ion collection plate 22, a magnitude and intensity of an electric field that is formed between the first high voltage application plate 21 and the ion collection plate 22 may be adjusted.

Negative (−) ions that are injected from the ion injection part 30 are pulled by attraction with the ion collection plate 22 to which a positive (+) high voltage is applied. As a magnitude of a positive (+) high voltage that is applied to the ion collection plate 22 increases, a magnitude of attraction that pulls negative (−) ions that are discharged from the ion injection part 30 to the ion collection plate 22 increases, and a magnitude of an electric field that is formed between the first high voltage application plate 21 and the ion collection plate 22 increases.

Negative (–) ions that are discharged from the ion injection part 30 more quickly move in a large quantity to the ion collection plate 22, and much more explosive exhaust gas particles may be unipolar charged by such positive ions.

Figure 17:
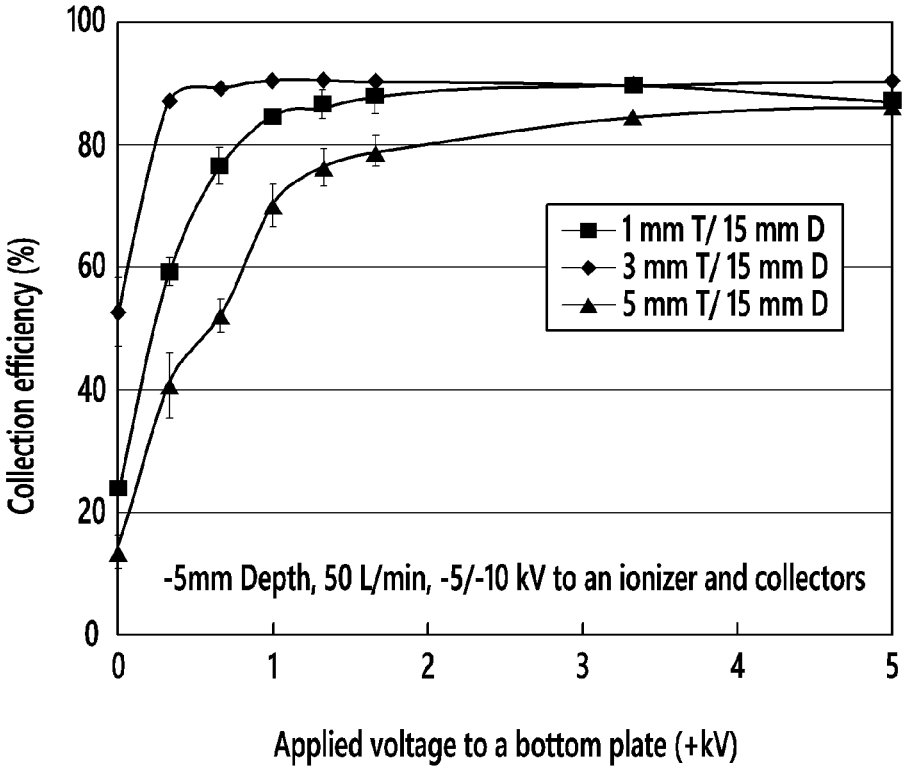
FIG. 17 is a diagram illustrating dust collection efficiency according to a high voltage application amount of FIG. 16.

FIG. 17 is a diagram illustrating dust collection efficiency according to a high voltage application amount of FIG. 16.

Referring to FIGS. 16 and 17, when a thickness of the first high voltage application plate 21 is 1 mm, even if a high voltage is not applied to the ion collection plate 22, dust collection efficiency of about 55% was represented. Thereafter, when a positive (+) high voltage is applied to the ion collection plate 22, dust collection efficiency rapidly increases to about 85% and then continuously increases.

As a thickness of the first high voltage application plate 21 increases, a magnitude of a high voltage that is applied to the ion collection plate 22 increases, but an increasing curved line of dust collection efficiency is similar to that when a thickness of the first high voltage application plate 21 is 1 mm.

Finally, when the first high voltage application plate 21 is electrically grounded and when a high voltage is applied to the ion collection plate 22, a magnitude of the applied high voltage is not limited and may be adjusted with required dust collection efficiency.

Compared with a case of FIG. 15, when a high voltage is applied to the first high voltage application plate 21, electrical induction occurs between the first high voltage application plate 21 and the ion injection part 30 and thus there is a limitation in applying a high voltage to the first high voltage application plate 21.

However, when the first high voltage application plate 21 is grounded and when a positive (+) high voltage is applied to the ion collection plate 22, electrical induction does not occur between the first high voltage application plate 21 and the ion injection part 30 and thus a high voltage may be applied to 1 kV or less and dust collection efficiency can be easily adjusted.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

| | | | |
|---|---|---|---|
| 1: | electrostatic precipitation device for removing particles in explosive exhaust gases | | |
| 10: | charging chamber | 11: | inflow pipe |
| 12: | outflow pipe | 13: | outlet |
| 14: | bypass pipe | 20: | charging portion |
| 21: | first high voltage application plate | | |
| 22: | ion collection plate | | |
| 24: | first water screen forming portion | | |
| 30: | ion injection part | | |
| 31: | communication pipe | 32: | discharge unit |
| 33: | insulating portion | | |
| 34: | flow velocity increase portion | | |
| 34a: | through-hole | | |
| 35: | fluid inlet | | |
| 40: | dust collection chamber | 41: | outflow pipe |
| 50: | electrostatic dust collection unit | | |

-continued

| | | | |
|---|---|---|---|
| 51: | second high voltage application plate | 52: | collection plate |
| 53: | second water screen forming portion | | |
| 53a: | spray unit | | |
| 53b: | cleaning liquid supply unit | | |

The invention claimed is:

1. An electrostatic precipitation device for removing particles in explosive exhaust gases, the electrostatic precipitation device comprising:

a charging chamber where an explosive exhaust gas flows in and out;

a charging unit comprising a first high voltage application plate that is installed within the charging chamber and to which a unipolar high voltage is applied and an ion collection plate that is spaced apart from the first high voltage application plate in a direction intersecting a flow direction of the explosive exhaust gas and is grounded;

at least one ion injection part comprising a communication pipe that communicates with the inside of the charging chamber and a discharge unit that is installed at an external end portion of the communication pipe to generate ions of the same polarity as that of a high voltage that is applied to the discharge unit, and transferring the generated ions to the inside of the charging chamber through the communication pipe;

a dust collection chamber where a unipolar charged explosive exhaust gas that is discharged from the charging chamber flows in; and an electrostatic dust collection unit that is installed within the dust collection chamber and comprising a second high voltage application plate, a collection plate that is spaced apart from the second high voltage application plate and is grounded, and a second water screen forming portion that forms a water screen at a plate surface of the collection plate.

2. The electrostatic precipitation device of claim 1, wherein the second high voltage application plate is installed such that a plate surface thereof is located at one side surface within the dust collection chamber, and the collection plate is installed such that a plate surface thereof is opposite to the second high voltage application plate at the other side surface within the dust collection chamber and is disposed in a vertical direction of the dust collection chamber.

3. The electrostatic precipitation device of claim 1, wherein the collection plate is hydrophilic surface processed.

4. The electrostatic precipitation device of claim 2, wherein the second water screen forming portion comprises:

a spray unit that is disposed in a horizontal direction of the collection plate to spray a cleaning liquid to the upper end of the collection plate such that a cleaning liquid drops along a surface of the collection plate; and a cleaning liquid supply unit that supplies a cleaning liquid to the spray unit.

5. The electrostatic precipitation device of claim 4, wherein the spray unit is a plurality of sprayers that are arranged in a horizontal direction of the collection plate or a pipe in which a plurality of nozzles are arranged in a horizontal direction of the collection plate.

6. The electrostatic precipitation device of claim 1, wherein the first high voltage application plate is installed such that a plate surface thereof is located as an upper surface and a lower surface at an upper portion within the charging chamber, and the ion collection plate is installed such that a plate surface thereof is opposite to a plate surface of the first high voltage application plate at a lower portion within the charging chamber, and the communication pipe is coupled to the charging chamber such that generated ions are injected between the high voltage application plate and the ion collection plate.

7. The electrostatic precipitation device of claim 1, comprising a plurality of ion injection parts including the ion injection part, wherein the plurality of ion injection parts are separately arranged in a flow direction of the explosive exhaust gas.

8. The electrostatic precipitation device of claim 7, wherein arrangement gaps of the plurality of ion injection parts are constantly formed, and the arrangement gap is larger than a distance between the first high voltage application plate and the ion collection plate.

9. The electrostatic precipitation device of claim 1, wherein the ion injection part further comprises a fluid inlet that an external fluid is injected through and forms fluid flow to the charging chamber side along the inside of the communication pipe.

10. The electrostatic precipitation device of claim 9, wherein the injected external fluid comprises ozone that primarily reacts a nitrogen compound among components of the explosive exhaust gas.

11. The electrostatic precipitation device of claim 10, wherein the cleaning liquid that is sprayed from the second water screen forming portion comprises a reducing solution that reduces the primarily reacted nitrogen oxide of the explosive exhaust gas.

12. The electrostatic precipitation device of claim 1, wherein the ion injection part further comprises a flow velocity increase portion having a plurality of through-holes and that is installed in a direction intersecting a fluid flow direction of the communication pipe.

13. The electrostatic precipitation device of claim 1, wherein the first high voltage application plate is installed such that a plate surface thereof is located at one side surface within the charging chamber, and the ion collection plate is installed such that a plate surface thereof is opposite to the first high voltage application plate at the other side surface within the charging chamber and is disposed in a vertical direction of the charging chamber.

14. The electrostatic precipitation device of claim 13, further comprising a first water screen forming portion that forms a water screen at the plate surface of the ion collection plate, wherein the first water screen forming portion comprises:

a spray unit that sprays a cleaning liquid to the upper end of the ion collection plate such that the cleaning liquid drops along a surface of the ion collection plate; and a cleaning liquid supply unit that supplies the cleaning liquid to the spray unit.

15. The electrostatic precipitation device of claim 1, further comprising a bypass pipe that is branched from an outflow pipe of the dust collection chamber and is connected with the fluid inlet of the ion injection part.

16. An electrostatic precipitation device for removing particles in explosive exhaust gases, the electrostatic precipitation device comprising:

a charging chamber where an explosive exhaust gas flows in and out;

a charging portion comprising a first high voltage application plate that is installed within the charging chamber and an ion collection plate that is separated from the first high voltage application plate;

an ion injection part that communicates with the inside of the charging chamber and that injects ions;

a dust collection chamber that is connected with the charging chamber and that collects particles of the explosive exhaust gas;

a first high voltage generator that is connected with the charging portion; and a second high voltage generator that is connected with the ion injection part and that is grounded together with the first high voltage generator, wherein the ion collection plate is in an electrically ground state, wherein the first high voltage generator comprises:

a first unipolar terminal that is connected with the first high voltage application plate; and a first ground terminal that is connected with the ion collection plate and that is electrically grounded, and wherein the second high voltage generator comprises:

a second unipolar terminal that is connected with the ion injection part; and a second ground terminal that is connected with the ion collection plate.

17. An electrostatic precipitation device for removing particles in explosive exhaust gases, the electrostatic precipitation device comprising:

a charging chamber where an explosive exhaust gas flows in and out;

a charging portion comprising a first high voltage application plate that is installed within the charging chamber and an ion collection plate that is separated from the first high voltage application plate;

an ion injection part that communicates with the inside of the charging chamber and that injects ions;

a dust collection chamber that is connected with the charging chamber and that collects particles of the explosive exhaust gas;

a first high voltage generator that is connected with the charging portion; and a second high voltage generator that is connected with the ion injection part and that is grounded together with the first high voltage generator, wherein the first high voltage application plate maintains an electrically ground state, wherein the first high voltage generator comprises:

a first unipolar terminal that is connected with the ion collection plate; and a first ground terminal that is connected with the first high voltage application plate, and wherein the second high voltage generator comprises:

a second unipolar terminal that is connected with the ion injection part; and a second ground terminal that is connected with the first high voltage application plate.

* * * * *